United States Patent [19]

Davis

[11] 3,940,962

[45] Mar. 2, 1976

[54] CONDUIT MAKING MACHINE WITH DIAMETER CONTROL AND METHOD

[75] Inventor: Paul Knight Davis, Alameda, Calif.

[73] Assignee: Pacific Roller Die Company, Incorporated, Hayward, Calif.

[22] Filed: May 9, 1974

[21] Appl. No.: 468,622

[52] U.S. Cl. ..... 72/50; 29/200 B; 29/202.5; 72/49; 72/138

[51] Int. Cl.[2] ..... B21C 37/12

[58] Field of Search ..... 72/138, 49, 50, 137; 29/477.3, 200 B, 202.5

[56] References Cited

UNITED STATES PATENTS

| | | | |
|---|---|---|---|
| 3,393,546 | 7/1968 | Fay | 72/138 |
| 3,417,587 | 12/1968 | Campbell | 72/50 |
| 3,604,464 | 9/1971 | Pelley | 72/49 |
| 3,614,882 | 10/1971 | Malkki | 72/138 |

*Primary Examiner*—C.W. Lanham
*Assistant Examiner*—Joseph A. Walkowski

[57] ABSTRACT

A machine and method for making spiral pipe from a continuous strip of sheet metal including a corrugating mill which forms corrugations in the strip and drives it through a three-roll bending mill which bends the strip into helical convolutions and guides adjacent edges thereof into an interlocking relationship and a pair of lock up rolls for crimping the interlocked edges of the convolutions into a continuous seam, which rolls are manually or automatically adjustable radially relative to the pipe axis whereby its diameter may be accurately controlled. Adjustment of said rolls radially inwardly effects a diameter increase whereas adjustment outwardly decreases the diameter of the pipe.

8 Claims, 14 Drawing Figures

CONDUIT MAKING MACHINE WITH DIAMETER CONTROL AND METHOD

BACKGROUND OF THE INVENTION

1. Field of the Invention

This invention relates to improvements in a machine for making spiral pipe from a strip of sheet metal. More particularly it concerns means and methods for accurately controlling the diameter of such pipe. As used herein the terms "tubing", "pipe", and "conduit" are used interchangeably and include all diameters and wall thicknesses or gauges, both corrugated and non-corrugated and lock seam or welded seam.

2. Description of the Prior Art

The improvement of this invention pertains to a machine of the type described in U.S. Pat. No. 3,247,692. In such a machine an elongated strip of sheet metal is driven at an oblique angle through three rolls, a guide roll, an anvil roll and a pressure roll, offset from each other to bend the strip, using the anvil roll as a fulcrum, into convolutions which, because of the entry angle of the strip, are helical. The resulting helical convolutions are joined at adjacent edges in a continuous seam by various means, such as a pair of lock up rolls positioned on opposite sides of the strip in line with the anvil roll which crimp preformed flanges on opposed longitudinal edges of the strip together in an interlocking relationship.

Three basic factors affect the diameter of the tubing made by such a three-roll machine: the width of the strip, the angle of entry of the strip through the rolls and the position of the pressure roll relative to the other two rolls. In operation, these three factors are held constant in an attempt to maintain the diameter of the tubing constant. However, due to various discrepancies resulting from the forces exerted on the three-roll structure by the weight, gauge (thickness) and diameter of the pipe and inherent variations in the strip camber, gauge, temper and the like, the strip may not be bent uniformly and the diameter of the finished pipe may "wander". Obviously, where uniform diameter is important, such as in the manufacture of pipe sections which are to be joined to other sections at their point of use or in the manufacture of conduit for heating ducts to be extended through preformed wall apertures, significant variation in the tubing diameter cannot be tolerated. Accordingly, inasmuch as the machine operator has no control over the strip width, adjustments of either or both of the entry angle and relative position of the pressure roll were required in order to control the diameter within specifications. Normally, such adjustments could only be made by temporarily shutting down the machine.

It has also been suggested that diameter control might be accomplished by varying the "lap" (depth of interlocking) of the flanges on the strip edges before crimping them together into a lock seam. In both welded-seam pipe and lock-seam pipe the relationship of the edges of the strip at the point of joining is exceedingly important. In order to form a proper welded seam the edges should abut with predetermined pressure and a properly formed lock seam is "full" in that the flanges are completely overlapped. Varying the lap of the edges by moving one or both of the lock up rolls axially relative to the tubing axis results in a nonuniform seam whose strength varies along its length depending upon the degree of lap effected. In bendable conduit, especially, such nonuniformity is undesirable and may result in buckling or seam separation.

SUMMARY OF THE INVENTION

The present invention relates to a method and apparatus for controlling the diameter of spiral tubing made with a three-roll mill which involves displacing the joined edges of the helical convolutions radially relative to the longitudinal axis of the tubing to correct for diameter deviations caused by the aforementioned discrepancies. In a lock-seam mill, such apparatus includes means for adjusting one or both of the lock up rolls radially inwardly or outwardly relative to the tubing axis, with outward adjustment causing the diameter to decrease and inward adjustment causing the diameter to increase. Such adjustments may be made easily without shutting the machine down and do not affect the uniformity of the seam formed by crimping the flanges on the strip edges between the lock up rolls.

The means to move one or both of these lock up rolls radially relative in the axis of the tubing may be designed for manual or automatic operation. For manual operation the rolls are fitted with screws which bear on the mountings therefor. By simply tightening or backing off said screws by hand the rolls are moved radially inwardly or outwardly. Monitoring the diameter of the tubing to ensure it is maintained within specifications may be made manually or automatically. For instance an operator may periodically measure the diameter with a ruler or tape measure. A possible automatic monitoring device is a flexible strip or belt which is placed around the girth of the tubing exiting from the bending mill which is associated with a gauge that senses and records fluctuations in the contraction or expansion of the belt. Such an automatic monitoring device may be further coupled to a servomechanism which effects an adjustment of the lock up rolls in accordance with this invention, thereby making the entire diameter control operation automatic.

Accordingly, the basic object of this invention is to provide an apparatus and method which is useful with existing machines and methods for making spiral tubing and which enables accurate control of the tubing diameter.

Another object of this invention is to provide such apparatus and method which may be operated and carried out without shutting down the tube making machine.

Yet another object is to provide an apparatus and method for controlling the diameter of the tubing which does not involve any variation in the structure of the seam which joins the convolutions of the tubing together.

A further object of this invention is to provide a method and apparatus for controlling the diameter of the tubing which are readily adaptable to complete automation.

BRIEF DESCRIPTION OF THE DRAWINGS

The drawings illustrate an embodiment of the invention which may be used to make relatively light gauge, corrugated, bendable conduit.

Figures 1, 2:
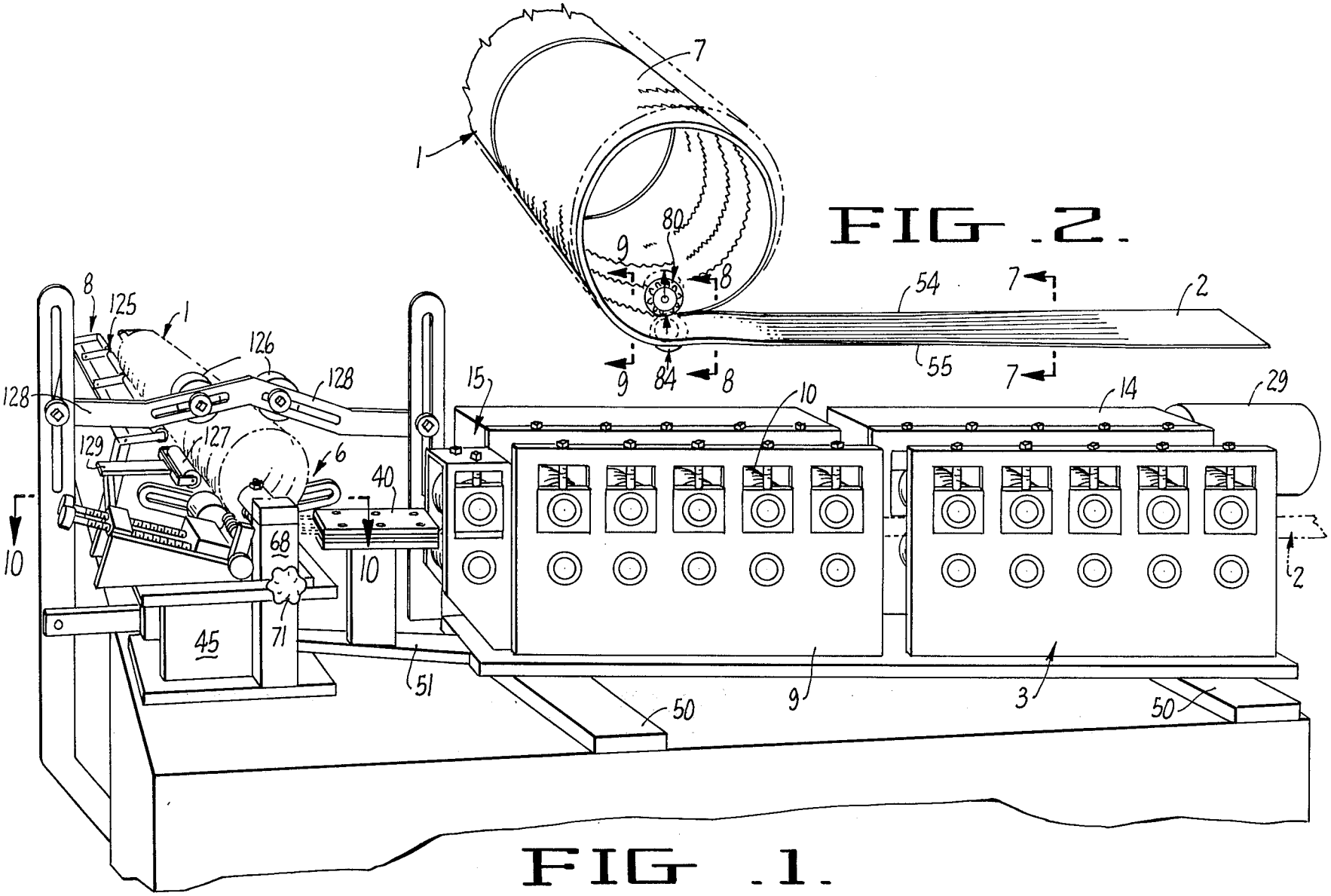
FIGS. 1 and 3 show the overall machine.
FIGS. 2, 6, 7, 8 and 9 illustrate the configuration of the strip and conduit at various stages of the corrugating and bending operations.
Figures 3, 4:
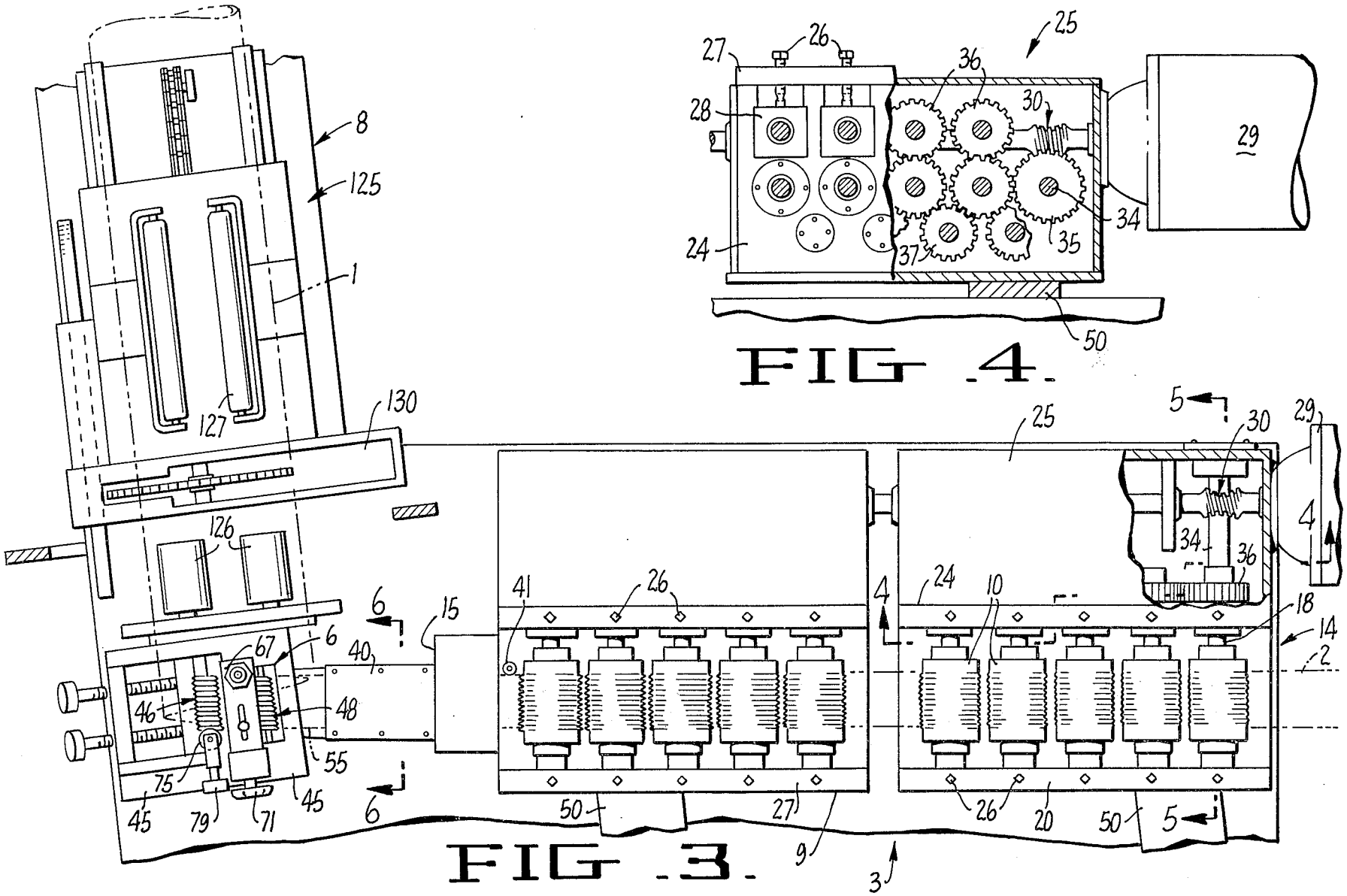
FIG. 4 depicts the drive mechanism for the machine.
Figure 5:
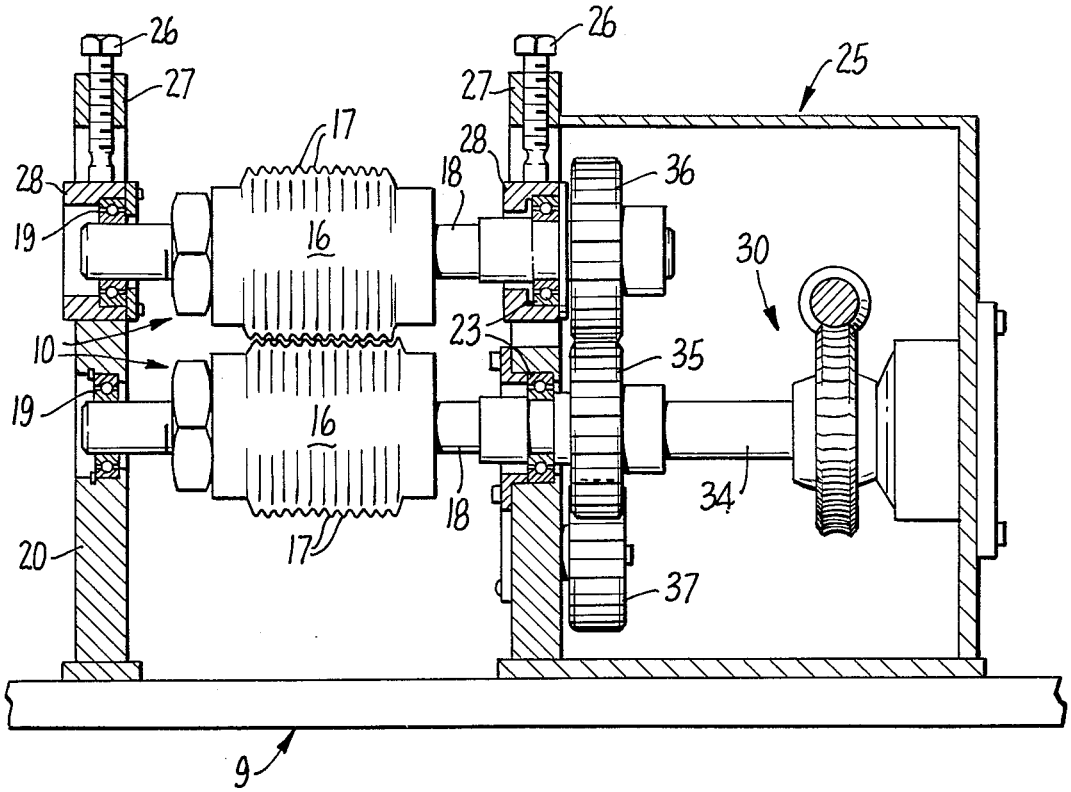
FIG. 5 shows the details of the corrugating mill.
Figure 6:
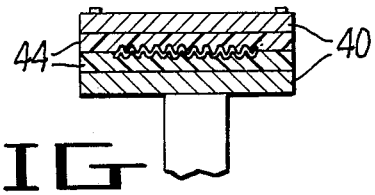
Figure 9:
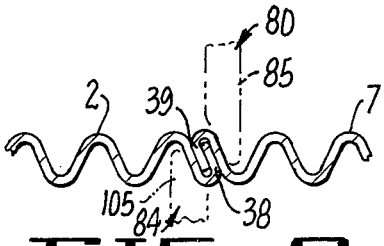
Figure 8:
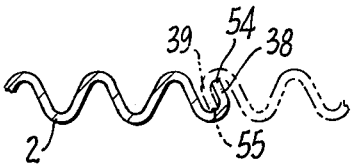
Figure 7:
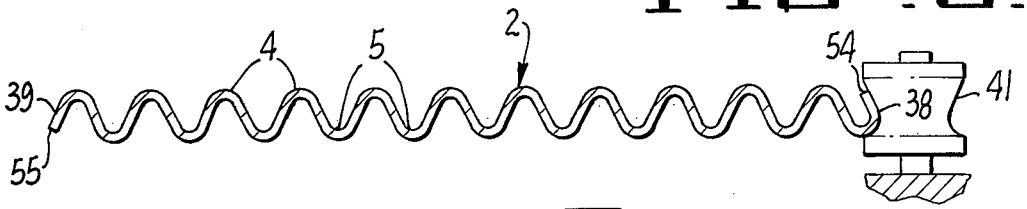
Figure 10:
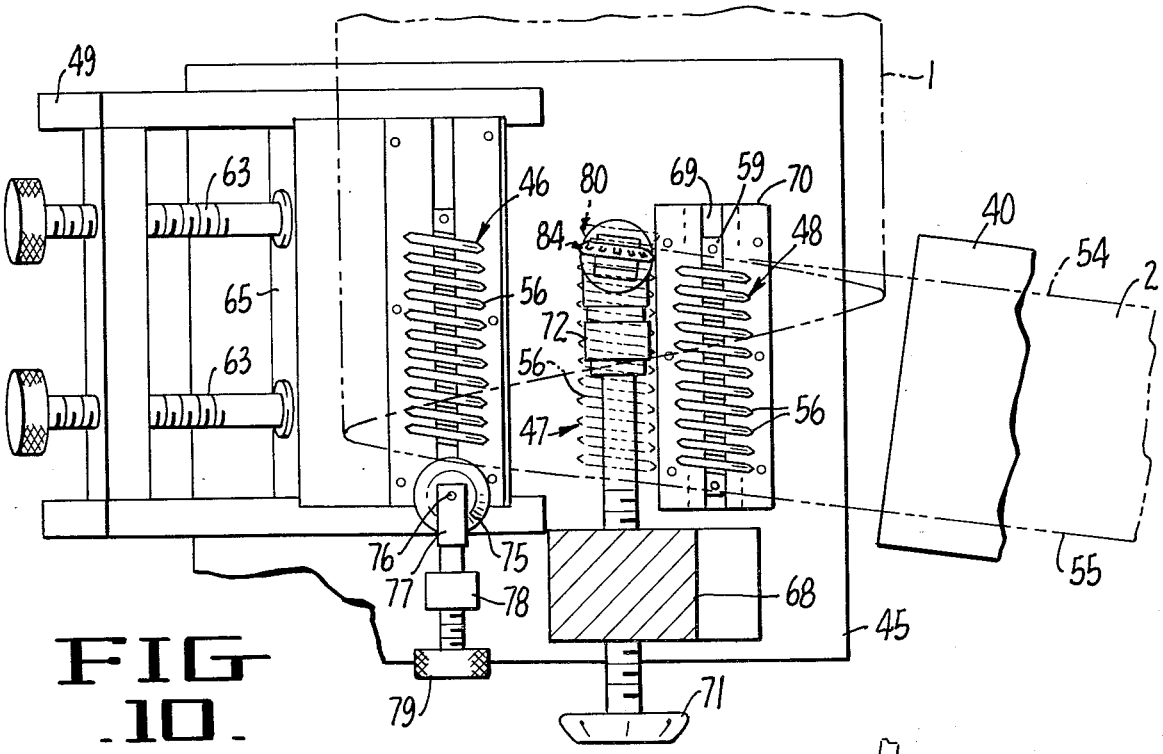
FIGS. 10 through 12 show details of the bending and seam forming portion of the machine. And, FIGS. 13 and 14 are detailed illustrations of the lock up roll construction.
Figure 11:
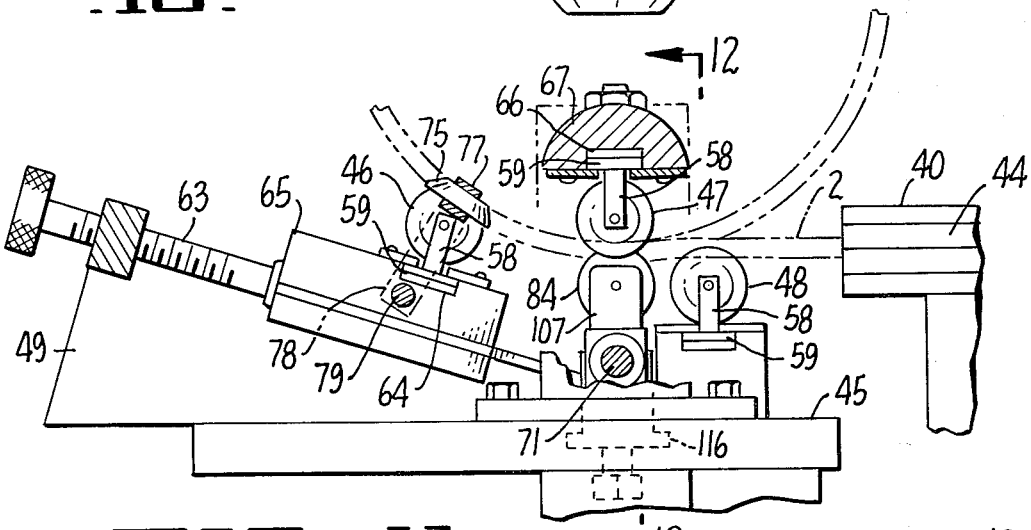
Figure 12:
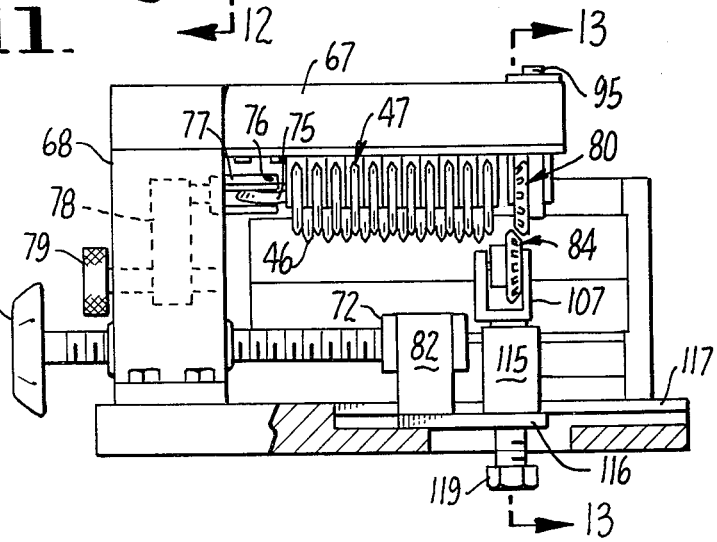
Figure 13:
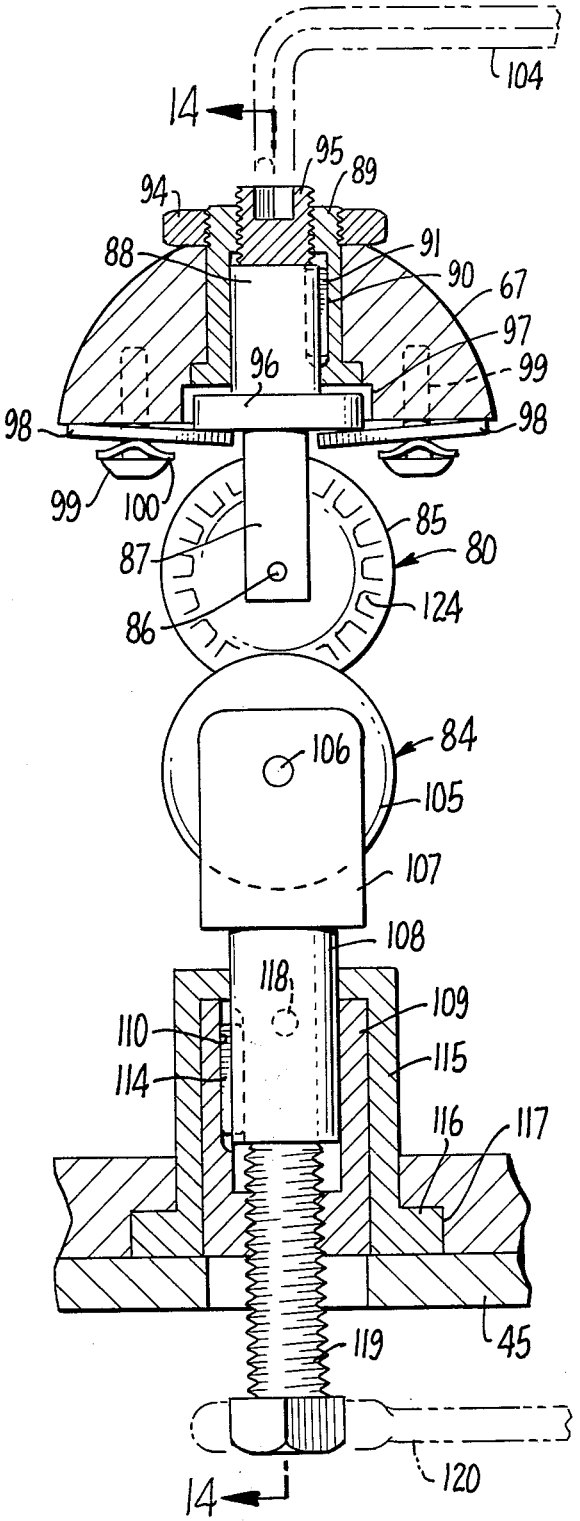
Figure 14:
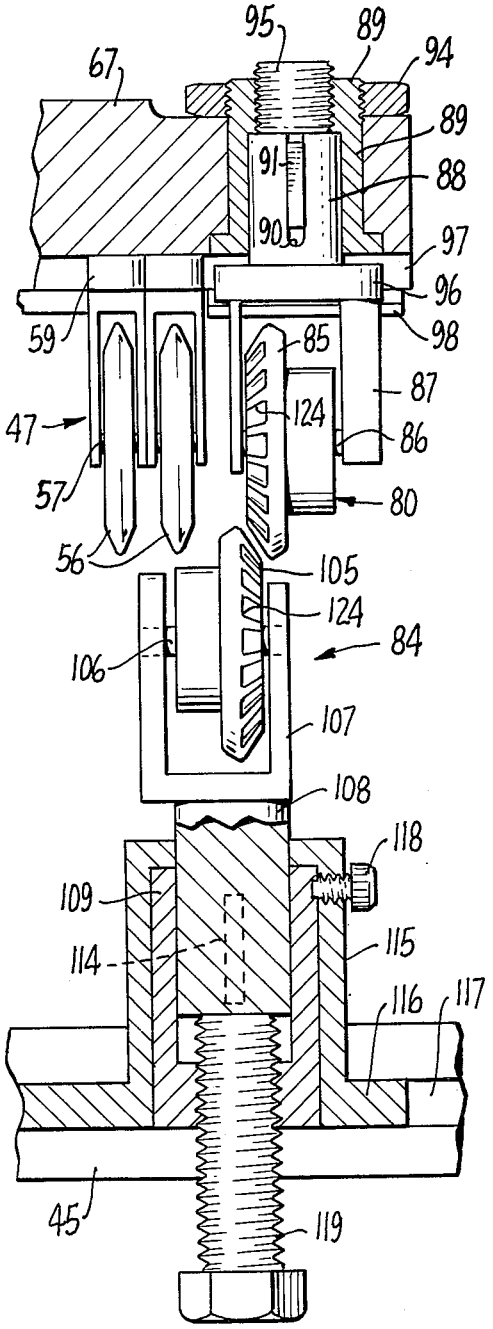

More specifically,

FIG. 1 is a perspective view of said embodiment;

FIG. 2 is a perspective view of a portion of strip being formed into tubing;

FIG. 3 is a top plan view of the embodiment of FIG. 1;

FIG. 4 is a partial sectional view taken along line 4—4 of FIG. 3;

FIG. 5 is an enlarged sectional view taken along line 5—5 of FIG. 3;

FIG. 6 is an enlarged sectional view taken along line 6—6 of FIG. 3;

FIG. 7 is an enlarged sectional view taken along line 7—7 of FIG. 2;

FIG. 8 is an enlarged, partial sectional view taken along line 8—8 of FIG. 2;

FIG. 9 is an enlarged, partial sectional view taken along line 9—9 of FIG. 2;

FIG. 10 is an enlarged sectional view taken along line 10—10 of FIG. 1;

FIG. 11 is an end elevational view of the apparatus shown in FIG. 10;

FIG. 12 is a sectional view taken along line 12—12 of FIG. 11;

FIG. 13 is an enlarged sectional view taken along line 13—13 of FIG. 12; and FIG. 14 is an enlarged sectional view taken along line 14—14 of FIG. 13.

Although the principle of this invention is applicable to mills for making pipe of various sizes and gauges, the specific machine depicted in the drawings is one which makes corrugated, bendable conduit of approximately 1 to 36 in. diameter from relatively light gauge sheet metal. Such conduit is conventionally used in building construction for heating ducts and the like. It should be understood that certain details of the depicted machine are applicable specifically to making such conduit and may or may not be required in embodiments of the invention intended for use in making other sizes, types and gauges of tubing.

In general the machine shown in the drawings (FIGS. 1 and 3) is arranged in three basic stations at which the components of the machine perform the sequence of steps— corrugating, forming, i.e. spiraling and seaming, and discharging—required to form finished corrugated, bendable conduit 1 from an elongated strip of sheet metal 2. The corrugating station or component of the machine, generally designated 3, receives the strip 2, forms longitudinal ridges 4 and valleys 5 (FIGS. 7–9) therein and advances it to the forming component of the machine, generally designated 6. At the forming station the sheet is bent into helical convolutions 7 (FIG. 2) and the adjacent edges thereof are joined to form a continuous seam. The conduit then proceeds to a discharge station, generally designated 8, where it is cut into lengths and received on a run out table for further processing and handling.

Corrugating station 3 (FIGS. 1, 3) comprises a carriage 9 which is an elongated frame which carries on its upper side a plurality of corrugating rolls 10. Corrugating rolls 10 are arranged in a plurality of stands or matched pairs (FIG. 5) each having an upper roll and a lower roll. The stands of rolls 10 are generally horizontally aligned so that the strip 2 will pass between the upper and lower rolls of each stand and be deformed thereby as the strip passes from the input end 14 of carriage 9 to the output end 15 thereof.

As shown in FIG. 5 each of rolls 10 comprises a generally cylindrical wheel or drum 16 with annular corrugations 17 on its longitudinal surface. Each wheel 16 is secured to a spindle 18 which is journalled at one end in bearings 19 in side wall 20 of carriage 9 and at the other end in bearings 23 in side wall 24 of gear box 25 (FIGS. 3–5). The upper roll of each stand is vertically adjustable by means of screws 26 which are received through a tie bar 27 and bear on the top surface of an upper slide block 28 of the bearing assembly therefor. The upper and lower rolls of each stand, as well as adjacent stands, are interconnected by the gearing in box 25 so that all rolls 10 are driven at the same speed. As shown in FIGS. 1 and 3–5, the rolls 10 are driven by an electric motor 29 which is coupled to a worm gear/cone drive mechanism, generally designated 30 (FIG. 5). The drive shaft 34 of mechanism 30 is coupled to spindle 18 of the lower roll 10 of the first stand in the series. Shaft 34 has a drive gear 35 mounted on it which meshes with and drives a spindle gear 36 mounted on the gear box end of spindle 18 of the top roll of the stand. Drive gear 35 also meshes with and drives an idler gear 37 which in turn meshes with the spindle gear of the lower roll of the next adjacent stand (FIG. 4) and so forth.

In the embodiment shown in the drawings there are eleven stands of corrugating rolls with sufficient corrugations 17 therein to form eleven corrugations across the width of strip 2. The corrugations on the lower roll are, of course, out of phase with respect to the corrugations on the upper roll so that the ridges of the former bisect the valleys of the latter and vice versa. It will be understood that the number of stands of rolls, the number of annular corrugations on a roll and the dimensions, i.e. depth and pitch, of said corrugations may be varied as desired depending on the specific size, type and gauge tubing which is being made. As seen in FIGS. 7–9 the depth-pitch ratio of the corrugations of the bendable conduit disclosed is relatively large compared to that used for other kinds of tubing such as large culvert pipe.

At the gear box side of the ends of the rolls 10 at output end 15 is mounted grooved edge roller 41 (FIG. 2) for forming a flange 38 (FIG. 7) on edge 54 of strip 2 in a manner similar to that disclosed in U.S. Pat. No. 3,247,692.

FIG. 7 illustrates a cross section of the sheet 2 as it emerges from the stands of corrugating rolls 10. As shown, edge 54 of the corrugated sheet terminates in an upwardly and slightly inwardly directed flange or locking lip 38. The opposite edge 55 terminates in downwardly directed flange (FIGS. 8, 9) or locking lip 39 formed by the action of rolls 10. These flanges 38, 39 are preferably formed generally centrally of oppositely inclined portions of the corrugations at the longitudinal edges of the strip. In this manner the seam formed by interlocking and crimping these flanges will lie in an inclined plane of a strip corrugation (preferably the mid-point thereof) rather than at the crest of a ridge or bottom of a valley thereof. As described hereinafter these flanges are subsequently engaged, interlocked and crimped into a continuous seam.

As the corrugated strip issues from the last stand of rolls 10 it passes between a pair of guide plates 40 (FIGS. 1, 2 and 6). Each guide plate 40 has a lining 44 of a low coefficient of friction material such as Teflon, which facilitates the sliding of the strip therebetween. Guide plates 40 merely serve to support the strip and keep it from being deformed in the space between corrugating station 3 and forming station 6.

Forming station 6 of the machine is of the three-roll type described in U.S. Pat. No. 3,247,692. It comprises a main frame 45 supporting a three roll strip spiraling mechanism (FIGS. 10–12) including a pressure roll 46, a central anvil roll 47 and a guide roll 48, intercepting the feed path of strip 2 from between guide plates 40. Anvil roll 47 and guide roll 48 are mounted at generally the same horizontal level, respectively, as the upper and lower rolls 10 of the corrugating stands so that opposite sides of the strip are engaged thereby. Pressure roll 46 is mounted on the opposite side of anvil roll 47 from guide roll 48 on an inclined ramp or way 49 so that its proximity to said anvil roll and its vertical and horizontal position relative to the feed path of strip 2 between rolls 47, 48 may be adjusted. As illustrated in FIG. 11 pressure roll 46 is positioned vertically above said feed path so that it engages the same side (bottom) of the strip as roll 48 and curls or spirals strip 2 upwardly into an arc using anvil roll 47 as a fulcrum as the strip is moved therethrough by the driving mechanism associated with corrugating station 3.

Supporting rolls 46, 47 and 48 with their axes at an oblique angle to the feed path of strip 2 causes the strip to be curled thereby into helical convolutions, the pitch angle of which is essentially the same as said oblique angle. As indicted above, that oblique angle is one of the three basic parameters which groosly determine the diameter of the finished conduit. In order to conveniently provide for variation of that oblique angle an arm 51 pivotally interconnects corrugating carriage 3 and frame 45 so that the former may be pivotally slid on support bars 50 (FIGS. 1 and 3). Said oblique angle is adjusted in relation to the width of strip 2 and the position of roll 46 so that the edge 55 of strip 2 when curled through a 360° convolution is adjacent the opposite edge 54 (FIG. 2) thereof. In this manner strip 2 is spiraled into closed convolutions which are joined at adjacent edges (as described hereinafter) to form finished conduit 1.

For curling corrugated strip it is preferable that rolls 46, 47 and 48 each comprise a plurality of individual rollers 56 (FIG. 10). The rollers 56 of each roll have peripheries conforming in size and shape to the corrugations 4, 5 in strip 2 so as to engage the same as the strip passes therebetween. Each roller is supported on its own shaft 57 mounted in a yoke 58 (FIG. 14). Each yoke 58 is mounted on a rectangular baseplate 59 and each baseplate 59 is slidably received within grooves 64, 66, 69 in an associated mounting member. Said grooves are similar in construction and are provided with inwardly extending lips 60 (FIG. 13) extending over the ends of baseplates 59 for retaining the same within said grooves.

Specifically, the baseplate for roll 46 is received within groove 64 of a block 65 which rides on ramp or way 49 (FIGS. 10, 11). The position of block 65 on the inclined surface of ramp 49 may be adjusted by means of screws 63. In this manner pressure roll 46 may be moved closer to or farther away from anvil roll 47 so as to curl sheet 2 in an arc of lesser or greater radius, respectively. The baseplate associated with roll 47 is received within groove 66 in the underside of a semicylindrical mandrel 67 which is secured to the top of a vertical column 68 which is bolted to the top side of frame 45. As seen in FIGS. 1, 10 and 12 mandrel 67 extends inwardly over the sheet and into the convolution thereof being formed by the rolls 46, 47, 48. The baseplate of guide roll 48 is received in groove 69 in mounting block 70 affixed to the top side of frame 45. The axial position of roll 48 relative to the other two rolls may be adjusted by means of an adjust screw 71 which is received through the bottom of column 68 and approximately affixed to a flange 72 protruding from the sides of block 70.

As seen in FIGS. 10–12 a flange completing roller, generally designated 74, is mounted on the outer side of block 65 for completing the forming of flange 39 on edge 55 of strip 2, i.e., for bending flange 39 back on strip 2 to a form similar to flange 38. Roller 74 includes a beveled wheel 75 mounted on a pin 76 journalled in a yoke 77 attached to an arm 78 which is attached to block 65 by a screw 79. As mentioned previously the thus formed flange 39 is ultimately interlocked with flange 38 on the opposite edge 54 of sheet 2 and crimped together tightly to form a continuous seam. This curling, flange forming and flange interlocking procedure is illustrated in FIGS. 2, 8 and 10.

As strip 2 is driven through rolls 46, 47 and 48 edge 55 is curled upwardly by the bending action of roll 46 and has the flange 39 formed in it by roller 74. Edge 55 travels in a helical path (shown in solid lines in FIG. 2 and in dot-dash lines in FIG. 10) from anvil roll 47 through approximately 360° to engage the opposite edge 54. Engagement of the flanges 38, 39 (FIG. 8) is facilitated not only by the particular shape of the flanges but also by the strip path. Edge 55 approaches edge 54 from above the latter (this is accentuated slightly by positioning anvil roll 47 such that it deforms or bows the strip downward slightly (FIG. 11) in a horizontally converging path. In other words, the downwardly directed flange 39 in edge 55 is inserted into engagement with the upwardly directed flange 38 on edge 54 along a path extending downwardly and inclined slightly in the direction of movement of the conduit discharging along the axis of the finished conduit. The inclination of such path of interengagement is preferably approximately the same as the inclination to which the flanges 38, 39 have been formed relative to the plane of strip 2. In this manner the flanges readily and fully engage each other at the point of intersection of the convolution with the incoming strip by following their respective natural paths. It is unnecessary to force the same into proper engagement and full overlap.

At or just after said point of intersection the interlocked flanges 38, 39 are passed between a pair of crimping or lock-up rolls, generally designated 80, 84 (FIGS. 12–14). It is in the radial positioning of these rolls relative to the conduit axis that the diameter of the finished conduit is controlled according to this invention. The upper lock-up roll 80 is mounted on the inner end of mandrel 67. It comprises a beveled wheel 85 mounted on a pin 86 journalled in a yoke 87. Yoke 87 has a cylindrical head 88 which is received within a support body 89 fitted within a bore in the inner end of mandrel 67. Support body 89 has a keyway 90 for receiving a key 91 for preventing rotation of head 88 within it. The top of body 89 is internally and externally threaded. The external threads receive a lock nut 94 which secures body 89 within the bore in mandrel 67. Said inner threads receive an adjust screw 95, the bottom of which bears on the top of head 88 of yoke 87. The lower end of head 88 has an annular flange 96 on it which sits within an enlarged counterbore 97 in mandrel 67 at the lower end of body 89. A pair of gibs 98 are attached to the bottom of mandrel 67 on either side of yoke 87 by means of cap screws 99 having spring washers 100 and extend inwardly over the edges of annular flanges 96.

Lock-up roll 80 is adjusted downwardly by tightening adjust screw 95 with allen wrench 104, thereby forcing head 88 downwardly against spring-backed gibs 98—and upwardly by backing off screw 95, whereby spring-backed gibs 98 will force head 88 upwardly.

Lower lock-up roll 84 is mounted on the top side of frame 45. Its construction is very similar to upper lock-up roll 80. It comprises beveled wheel 105 mounted on a pin 106 journalled in a yoke 107. Yoke 107 had a cylindrical head 108 which is received within a support body 109 having a keyway 110 for receiving a key 114 for preventing the rotation of head 108 within it. Support body 109 is in turn held within a housing 115 having a flange 116 which slidably fits within a way 117 in frame 45. Body 109 is secured within housing 115 by means of a set screw 118. Body 109 has a threaded bore in its lower end which receives an adjustment screw 119, the top of which bears on the top of head 108. Lower lock-up roll 84 is adjusted upwardly by tightening screw 119 with a wrench 120 and downwardly by simply backing off on screw 119. Both adjustment screws 95, 119 are accessible so they may be operated and the tubing diameter thus controlled during the tubing-making operation.

As illustrated in phantom in FIG. 9 the interlocked flanges 38, 39 pass between the wheels 85, 105 of lock-up rolls 80, 84, respectively, and are pinched tightly together thereby forming a continuous seam which holds the convolutions 7 together in the form of a continuous conduit 1. As wheels 85, 105 pinch flanges 38, 39 together, the interengaging knurling 124 (FIGS. 13, 14) on the beveled surfaces of wheels 85, 105 between which flanges 38, 39 are being pinched forms a continuous series of spaced crimps or indentations in said continuous seam. These crimps prevent circumferental slippage between lips 38, 39, strengthen the seam and keep it held firmly together under the stresses applied to the conduit when it is bent.

The pressure applied to the seam by lock-up rolls 80, 84 may be adjusted by hand-wheel screw 71 (FIGS. 10–12) threaded through column 68 and attached to block 82. The bottom of block 82 is attached to flange 116 of yoke housing 115 for roll 84 so that it is translated toward and away from roll 80 by turning screw 81.

Pursuant this invention the diameter of conduit 1 may be controlled accurately by simultaneously raising or lowering lock-up rolls 80, 84 in the manner described above. As illustrated in FIG. 2 when these rolls are raised, i.e. they are moved radially inwardly relative to the axis of the conduit, the diameter of conduit 2 will increase. Correlatively, when they are lowered, i.e. moved radially outwardly relative to the conduit axis, the diameter decreases. It should be understood that the diameter changes effected by such movement are minor and occur gradually. For instance, in a machine for making 1 to 36 inch diameter conduit, such adjustments may be used to effect diameter changes of approximately ± one-fourth inch. Major diameter changes should be made by varying said oblique angle and the position of pressure roll 46, usually in setting up the mill for a different diameter.

Such radial movement of the lock-up rolls affects the diameter by effectively increasing or decreasing the length of the first helix (the distance from the point on edge 55 of strip 2 at which the convolution begins to the point thereon where it is pinched together with edge 54 by the lock-up rolls). When a discrepancy occurs in the pipe-making process or material that causes the diameter to wander or deviate from that for which the machine is set, it means the length of the first helix (which is what determines the diameter) has changed. The diameter control of this invention, therefore, effects a correction of the diameter change by displacing the opposing edges of the strip in the first helix back to their proper radial location while at the same time maintaining them in proper lapping position for forming into a lock seam or abutting position for joining in a welded seam.

In the embodiment shown in the drawings rolls 80, 84 are adjusted individually and manually by means of adjusting screws 95, 119. It is also feasible to have only one of the rolls adjustable manually and have the other react with respect to such adjustment. For instance the reacting roll might be spring backed so that it moves upwardly or downwardly in accordance with the upward or downward movement of the positively adjusted roll. It also is feasible to make the entire adjustment automatic. For instance, means for monitoring the diameter may be included in the machine (e.g. a belt or loop detector) which, when it sensed a given diameter deviation would activate a servomechanism which in turn lowered or raised the lock-up rolls to correct the deviation.

There are various mechanical means by which the diameter control of this invention may be effected. For example, in a large mill for making pipe from 6 to 120 inches in diameter from 18 to 8 gauge sheet metal the upper lock seam roll may be supported on a wedge-shaped control element, lateral movement of which effects vertical adjustment of said upper roll pinching the lock seam against the lower lock seam roll which is spring-urged upwardly.

In the case of smooth-wall welded-seam pipe the simplest form of edge-displacement diameter control means is a pair of plain, cylindrical rollers on opposite sides of and straddling the abutting edges. Other forms of such control means may be readily devised within the scope of this invention to accommodate to the exigencies of the particular pipe and seam design.

As the tubing emerges from forming station 6 it is received by discharge station 8 (FIGS. 1 and 3). Discharge station 8 includes a run off table 125 made from a plurality of frame numbers and a plurality of tubing support rollers of conventional construction. Station 8 may also include a saw, generally designated 130, or other cut-off means which is used to cut the finished tubing into sections of predetermined length. Examples of the same are described in U.S. Pat. Nos. 3,198,043 and 3,369,432.

Modifications of the above described embodiments and portions thereof which are obvious to those of skill in the mechanical arts, and particularly the tubing making art, are intended to be within the scope and spirit of the following claims.

I claim:

1. In a machine for making spiral pipe from an elongated strip of ductile sheet material including apparatus for continuously bending said strip into helical convolutions and guiding the opposed edges of said strip into adjoining relationship and means for joining said edges into a continuous seam, the improvement comprising:

a. opposed rollers engaging opposite sides of said strip at said joined edges and simultaneously radially movable from controlling the diameter of the pipe by radially displacing the position at which said edges are joined without relatively axially displacing said edges.

2. The improvement of claim 1, in which:

b. said opposed rollers being operated in response to discrepancies in bending said sheet material that cause the diameter of said pipe to deviate from the desired diameter.

3. The improvement of claim 1, including:

b. adjustable means supporting said rollers to effect such displacement.

4. The improvement of claim 3, including:

c. means operable during operation of said machine for adjusting said adjustable means.

5. In a machine for making spiral, lock seam tubing from an elongated strip of sheet metal including apparatus for forming flanges on the opposed longitudinal edge of said strip, a mill for continuously bending said strip into helical convolutions and guiding said flanges into interlocking relationship, and opposed rollers engaging opposite sides of said flanges for crimping the same into a continuous seam, the improvement comprising:

a. means for simultaneously radially adjusting the position of said opposed rollers relative to the longitudinal axis of said tubing for maintaining the desired diameter of tubing.

6. In a method of making spiral pipe from an elongated strip of ductile sheet material including continuously bending said strip into helical convolutions and joining adjacent edge of said convolutions together to form pipe, the improvement comprising:

a. embracing opposite sides of said edges by rollingly engaging the same at the point at which said joining occurs, and b. simultaneously radially displacing said edges at said point in response to deviations of the diameter of said pipe from that desired while at the same time maintaining the relative axial relationship of said edges.

7. In a method of making spiral, lock seam tubing from an elongated strip of sheet metal including forming flanges in opposite edges of said strip, bending said strip into helical convolutions, guiding said flanges into interlocking relationship and rollingly crimping said interlocked flanges into a continuous seam, the improvement comprising:

a. controlling the diameter of the tubing by simultaneously adjusting the point at which said crimping occurs radially in relation to the axis of said tubing while at the same time maintaining the relative axial relationship of said flanges.

8. The improvement according to claim 7 wherein:

b. adjustment of said point inwardly effects an increase in said diameter and adjustment of said point outwardly effects a decrease in said diameter.

* * * * *